US008899199B1

(12) United States Patent
Waters

(10) Patent No.: US 8,899,199 B1
(45) Date of Patent: Dec. 2, 2014

(54) CAMSHAFT PHASER AND LOCK PIN THEREOF

(71) Applicant: Delphi Technologies, Inc., Troy, MI (US)

(72) Inventor: James P. Waters, Waterford, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/062,105

(22) Filed: Oct. 24, 2013

(51) Int. Cl.
*F01L 1/34* (2006.01)
*F01L 1/344* (2006.01)

(52) U.S. Cl.
CPC ..... *F01L 1/344* (2013.01)
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS

| | | | | |
|---|---|---|---|---|
| 5,960,757 | A | 10/1999 | Ushida | |
| 8,056,519 | B2 | 11/2011 | Cuatt et al. | |
| 8,689,748 | B2 * | 4/2014 | Watanabe | 123/90.17 |
| 2012/0255509 | A1 | 10/2012 | Lichti et al. | |

* cited by examiner

*Primary Examiner* — Ching Chang
(74) *Attorney, Agent, or Firm* — Thomas N. Twomey

(57) ABSTRACT

A camshaft phaser for varying the phase relationship between a crankshaft and a camshaft includes stator having a plurality of lobes. A rotor rotatable about a camshaft axis is disposed coaxially within the stator and has a plurality of vanes interspersed with the lobes to define advance chambers and retard chambers. A lock pin is slidably disposed along a lock pin axis within the rotor for selective engagement with a first lock pin seat and for selective engagement with a second lock pin seat. The lock pin has a lock pin width in a circumferential direction relative to the camshaft axis and a lock pin length perpendicular to the lock pin width and to the lock pin axis such that the lock pin width is less than the lock pin length.

15 Claims, 5 Drawing Sheets

CAMSHAFT PHASER AND LOCK PIN THEREOF

TECHNICAL FIELD OF INVENTION

The present invention relates to a hydraulically actuated camshaft phaser for varying the phase relationship between a crankshaft and a camshaft in an internal combustion engine; more particularly to such a camshaft phaser that is a vane-type camshaft phaser; even more particularly to a vane-type camshaft phaser which includes a lock pin and a pair of lock pin seats for selectively preventing a change in phase relationship at a first predetermined position and at a second predetermined position; and still even more particularly to a vane-type camshaft phaser in which the lock pin and lock pin seats are elongated in a radial direction relative to a camshaft axis about which the camshaft rotates.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vented from the other of the advance and retard chambers in order to rotate the rotor within the stator and thereby change the phase relationship between an engine camshaft and an engine crankshaft. Camshaft phasers also commonly include a lock pin which is selectively seated with a lock pin seat to prevent relative rotation between the rotor and the stator at a predetermined aligned position between the rotor and the stator that is intermediate of a full advance position and a full retard position. The lock pin is engaged and disengaged with the lock pin seat by venting oil from the intermediate lock pin and by supplying pressurized oil to the lock pin respectively. Preventing relative rotation between the rotor and the stator at a position that is intermediate of the full advance position and the full retard position may be desirable, particularly for a camshaft phaser which varies the timing of the intake valves, for providing strong torque for starting the internal combustion engine before the internal combustion engine has been warmed to operating temperature.

In an effort to conserve fuel, the internal combustion engine of some motor vehicles is automatically turned off, rather than allowing the internal combustion engine to idle, when the motor vehicle comes to a stop, for example, when the motor vehicle is stopped at a traffic light. This event may be known as automatic stop mode because the operator of the internal combustion engine has not turned off the ignition to the motor vehicle and various subsystems operate on battery power in anticipation of a near-term restart of the internal combustion engine. The internal combustion engine is then automatically restarted when propulsion is again desired which may be determined, for example, by the operator of the motor vehicle removing their foot from the brake pedal or applying pressure to the accelerator pedal. It may not be desirable to prevent relative rotation between the rotor and the stator at a position that is intermediate of the full advance position and the full retard position when the internal combustion engine is operating in the automatic stop mode because the engine would typically be operating at normal operating temperature and, as a result, the internal combustion engine would be restarted with too much torque which may be objectionable to the operator of the motor vehicle. Consequently, it may be desirable to provide a second lock pin seat at a different angular position than the first lock pin seat, for example, the full retard position, to allow the lock pin to prevent relative rotation between the rotor and the stator at a position which provides less torque when restarting the internal combustion at the normal operating temperature.

Implementation of multiple locking positions may be difficult because the angular separation between the two lock pin seats using commonly known lock pins with a cylindrical cross-sectional shape may be sufficiently close that the lock pin and lock pin seats can provide fluid communication between one of the advance chambers and one of the retard chambers when the rotor is rotated such that the lock pin is centered, or close to centered, between the first lock pin seat and the second lock pin which may result in undesired performance of the camshaft phaser. Providing fluid communication between one of the advance chambers and one of the retard chambers may be avoided by providing sufficient angular separation between the two lock pin seats, however, providing sufficient angular separation to avoid fluid communication between one of the advance chambers and one of the retard chambers may result in the predetermined aligned position which is between full advance and full retard being in a location that is not desired, or may result in loss of phase angle authority of the camshaft phaser.

What is needed is a camshaft phaser which minimizes or eliminates one or more the shortcomings as set forth above.

SUMMARY OF THE INVENTION

Briefly described, a camshaft phaser for use with an internal combustion engine for controllably varying the phase relationship between a crankshaft and a camshaft in the internal combustion engine includes a stator having a plurality of lobes and is connectable to the crankshaft of the internal combustion engine to provide a fixed ratio of rotation between the stator and the crankshaft. The camshaft phaser also includes a rotor disposed within the stator, the rotor having a plurality of vanes interspersed with the lobes such that the rotor is rotatable within the stator about a camshaft axis and defining alternating advance chambers and retard chambers, wherein the advance chambers receive pressurized oil in order to change the phase relationship between the crankshaft and the camshaft in an advance direction and the retard chambers receive the pressurized oil in order to change the phase relationship between the camshaft and the crankshaft in a retard direction. A lock pin is slidably disposed along a lock pin axis within one of the rotor and the stator for selective engagement with a first lock pin seat for preventing a change in phase relationship between the rotor and the stator at a first predetermined aligned position of the rotor relative to the stator and for selective engagement with a second lock pin seat for preventing a change in phase relationship between the rotor and the stator at a second predetermined aligned position of the rotor relative to the stator. The lock pin has a lock pin width in a circumferential direction relative to the camshaft axis and a lock pin length perpendicular to the lock pin width and to the lock pin axis such that the lock pin width is less than the lock pin length. In this way, the lock pin is sufficiently strong to prevent relative rotation between the rotor and the stator while preventing the lock pin and lock pin seats from providing fluid communication between one of the advance chambers and one of the retard chambers.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
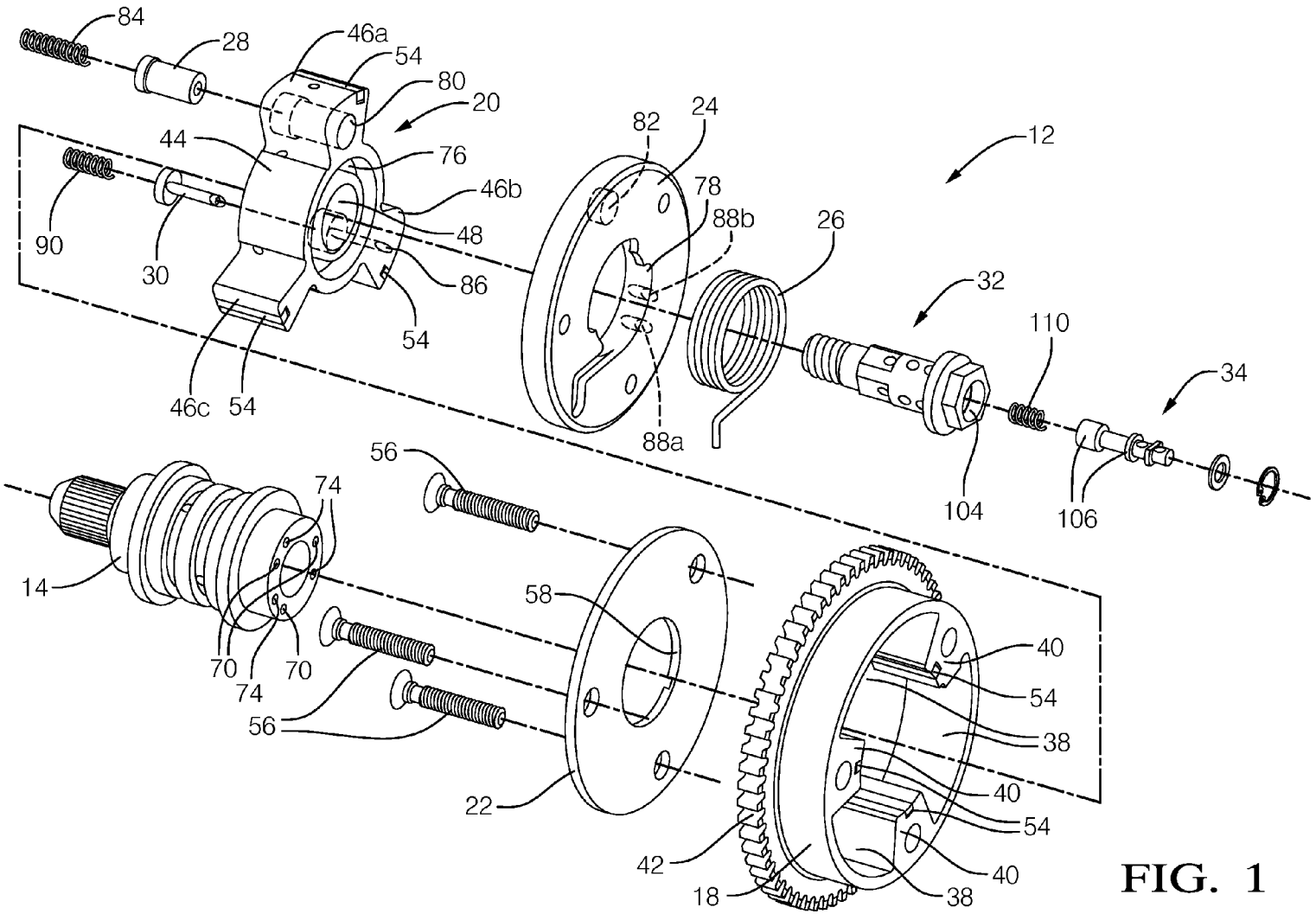
FIG. 1 is an exploded isometric view of a camshaft phaser in accordance with the present invention.
Figure 2:
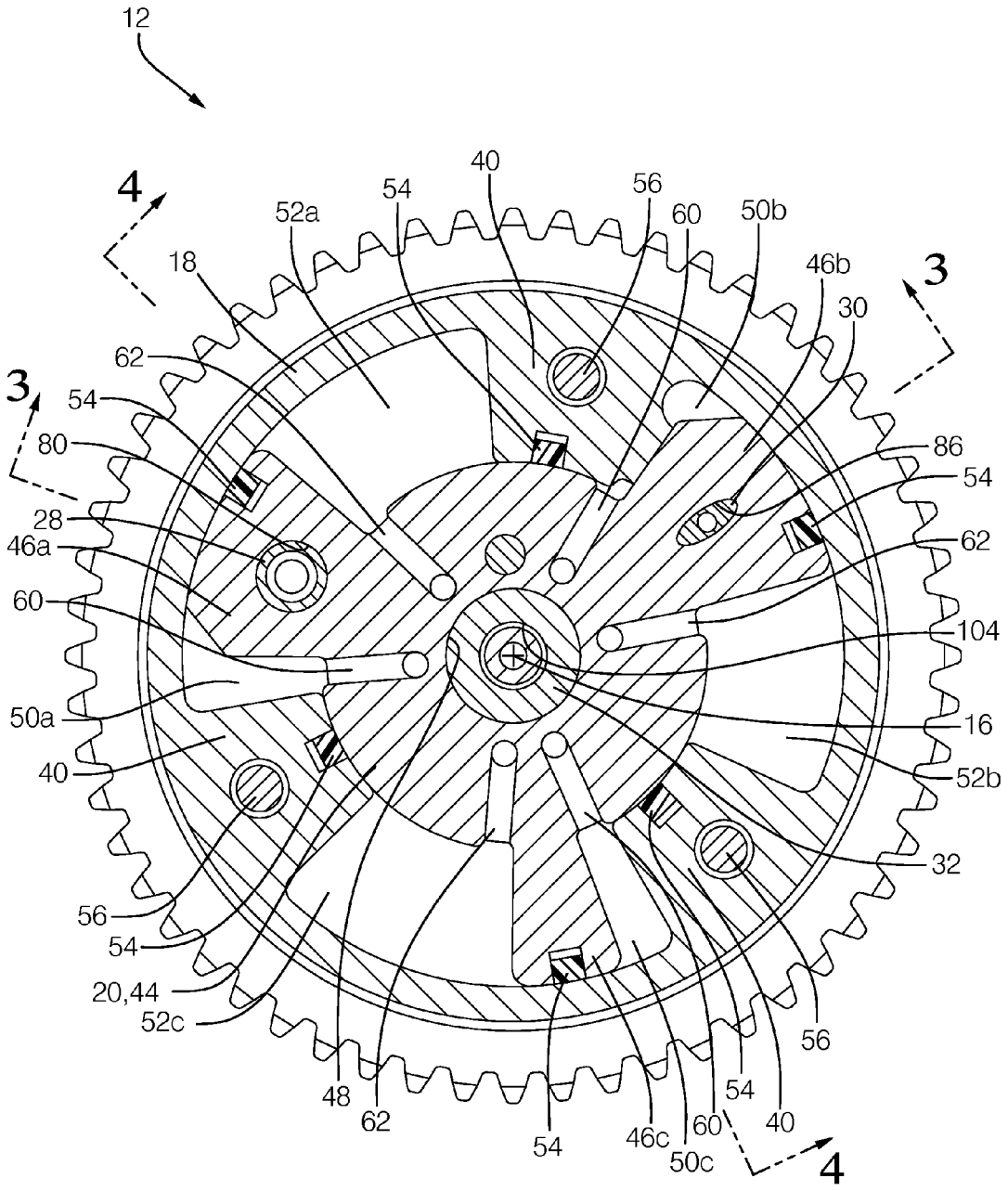
FIG. 2 is a radial cross-sectional view of the camshaft phaser in accordance with the present invention.
Figure 3:
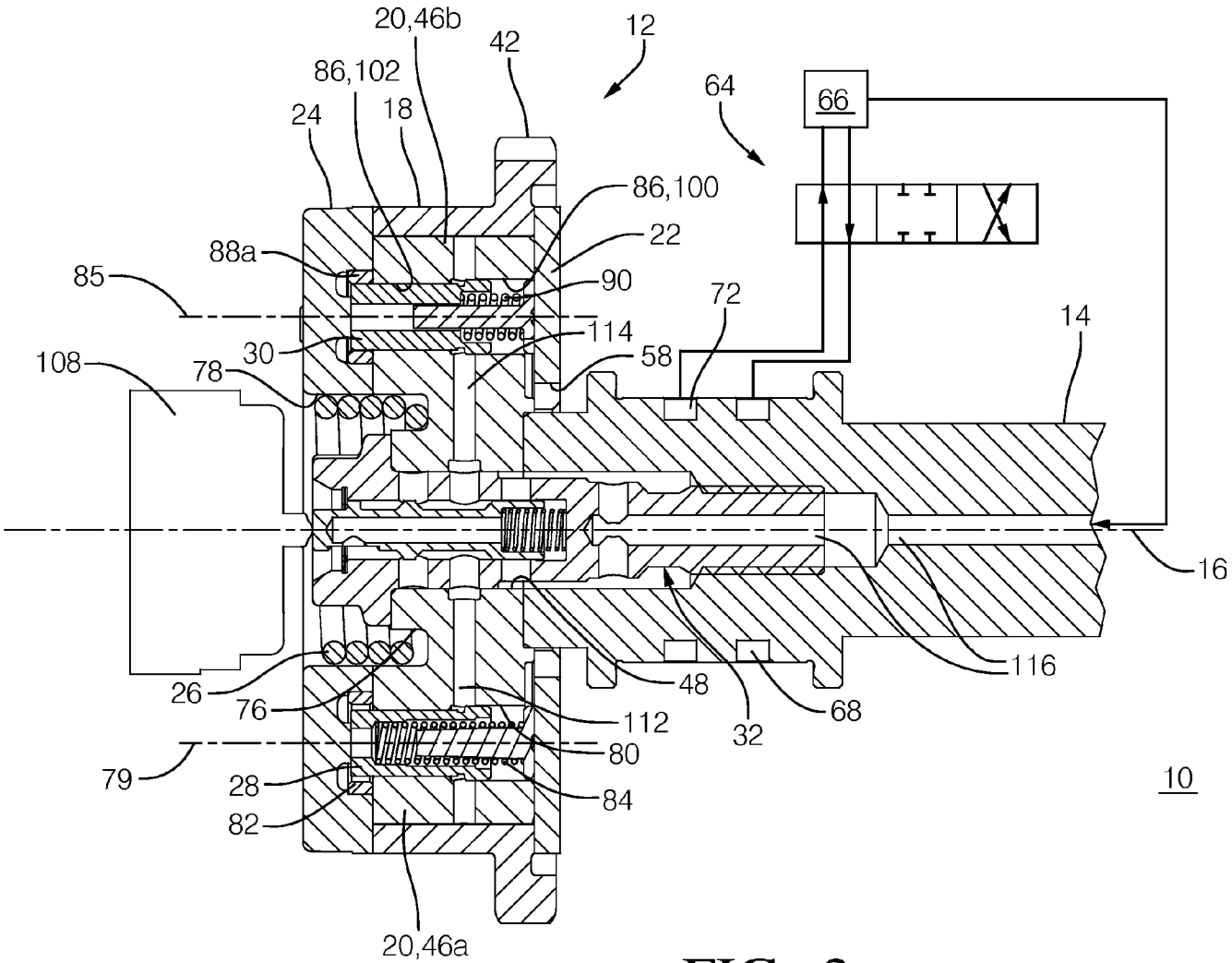
FIG. 3. is an axial cross-sectional view of the camshaft phaser in accordance with the present invention taken through section line 3-3 of FIG. 2.
Figure 4:
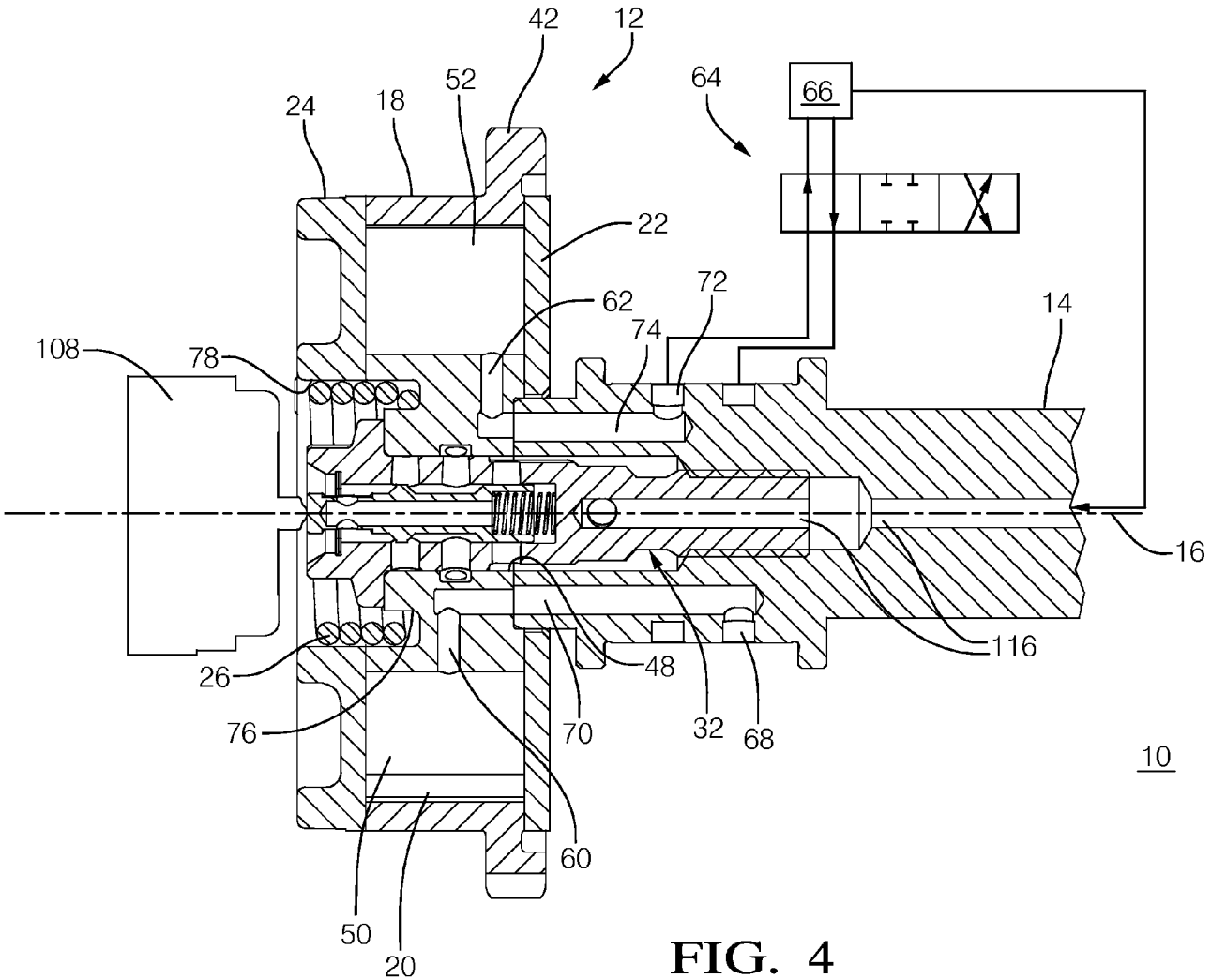
FIG. 4. is an axial cross-sectional view of the camshaft phaser in accordance with the present invention taken through section line 4-4 of FIG. 2.

In accordance with a preferred embodiment of this invention and referring to FIGS. 1, 2, 3, and 4, an internal combustion engine 10 is shown which includes a camshaft phaser 12. Internal combustion engine 10 also includes a camshaft 14 which is rotatable about a camshaft axis 16 based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 18, a rotor 20 disposed coaxially within stator 18, a back cover 22 closing off one end of stator 18, a front cover 24 closing off the other end of stator 18, a bias spring 26 for urging rotor 20 in one direction relative to stator 18, a primary lock pin 28, a secondary lock pin 30, a camshaft phaser attachment bolt 32 for attaching camshaft phaser 12 to camshaft 14, and a lock pin control valve spool 34 for controlling pressurized oil supplied to and vented from primary lock pin 28 and secondary lock pin 30. The various elements of camshaft phaser 12 will be described in greater detail in the paragraphs that follow.

Stator 18 is generally cylindrical and includes a plurality of radial chambers 38 defined by a plurality of lobes 40 extending radially inward. In the embodiment shown, there are three lobes 40 defining three radial chambers 38, however, it is to be understood that a different number of lobes 40 may be provided to define radial chambers 38 equal in quantity to the number of lobes 40. Stator 18 may also include a sprocket 42 formed integrally therewith or otherwise fixed thereto. Sprocket 42 is configured to be driven by a chain or gear that is driven by the crankshaft of internal combustion engine 10. Alternatively, sprocket 42 may be a pulley driven by a belt.

Rotor 20 includes a central hub 44 with a plurality of vanes 46*a*, 46*b*, 46*c* extending radially outward therefrom and a central through bore 48 extending axially therethrough. From this point forward, each vane 46*a*, 46*b*, 46*c* will be referred to generically as vane 46 unless reference is being made to a specific vane 46. The number of vanes 46 is equal to the number of radial chambers 38 provided in stator 18. Rotor 20 is coaxially disposed within stator 18 such that each vane 46 divides each radial chamber 38 into advance chambers 50*a*, 50*b*, 50*c* and retard chambers 52*a*, 52*b*, 52*c*. From this point forward, each advance chamber 50*a*, 50*b*, 50*c* will be referred to generically as advance chamber 50 unless reference is being made to a specific advance chamber 50. Similarly, each retard chamber 52*a*, 52*b*, 52*c* will be referred to generically as retard chamber 52 unless reference is being made to a specific retard chamber 52. The radial tips of lobes 40 are mateable with central hub 44 in order to separate radial chambers 38 from each other. Each of the radial tips of lobes 40 and the tips of vanes 46 may include one of a plurality of wiper seals 54 to substantially seal adjacent advance chambers 50 and retard chambers 52 from each other.

Back cover 22 is sealingly secured, using cover bolts 56, to the axial end of stator 18 that is proximal to camshaft 14. Tightening of cover bolts 56 prevents relative rotation between back cover 22 and stator 18. Back cover 22 includes a back cover central bore 58 extending coaxially therethrough. The end of camshaft 14 is received coaxially within back cover central bore 58 such that camshaft 14 is allowed to rotate relative to back cover 22. In an alternative arrangement, sprocket 42 may be integrally formed or otherwise attached to back cover 22 rather than to stator 18 as described previously.

Similarly, front cover 24 is sealingly secured, using cover bolts 56, to the axial end of stator 18 that is opposite back cover 22. Cover bolts 56 pass through stator 18 and threadably engage front cover 24, thereby clamping stator 18 between back cover 22 and front cover 24 to prevent relative rotation between stator 18, back cover 22, and front cover 24. In this way, advance chambers 50 and retard chambers 52 are defined axially between back cover 22 and front cover 24.

Camshaft phaser 12 is attached to camshaft 14 with camshaft phaser attachment bolt 32 which extends coaxially through central through bore 48 of rotor 20 and threadably engages camshaft 14, thereby clamping rotor 20 securely to camshaft 14. In this way, relative rotation between stator 18 and rotor 20 results in a change in phase relationship or timing between the crankshaft of internal combustion engine 10 and camshaft 14.

Pressurized oil is selectively supplied to advance chambers 50 and vented from retard chambers 52 in order to cause relative rotation between stator 18 and rotor 20 which results in advancing the timing of camshaft 14 relative to the crankshaft of internal combustion engine 10. Conversely, oil is selectively supplied to retard chambers 52 and vented from advance chambers 50 in order to cause relative rotation between stator 18 and rotor 20 which results in retarding the timing of camshaft 14 relative to the crankshaft of internal combustion engine 10. Advance oil passages 60 may be provided in rotor 20 for supplying and venting oil to and from advance chambers 50 while retard oil passages 62 may be provided in rotor 20 for supplying and venting oil to and from retard chambers 52. Supplying and venting of oil to and from advance chambers 50 and retard chambers 52 may be controlled by a phasing oil control valve 64 located external to camshaft phaser 12, for example, within internal combustion engine 10. Phasing oil control valve 64 is shown in schematic form in FIGS. 3 and 4 and receives pressurized oil from an oil source 66, for example an oil pump used to lubricate various components of internal combustion engine 10. When it is desired to advance the timing of camshaft 14 relative to the crankshaft, phasing oil control valve 64 is operated to supply pressurized oil to advance chambers 50 while venting oil from retard chambers 52. Pressurized oil from phasing oil control valve 64 is supplied to advance chambers 50 through annular camshaft advance oil passage 68 of camshaft 14, axial camshaft advance oil passages 70 of camshaft 14, and advance oil passages 60 of rotor 20. At the same time, oil is vented from retard chambers 52 through annular camshaft retard oil passage 72 of camshaft 14, axial camshaft retard oil passages 74 of camshaft 14, and retard oil passages 62 of rotor 20. Conversely, when it is desired to retard the timing of camshaft 14 relative to the crankshaft, phasing oil control valve 64 is operated to supply pressurized oil to retard chambers 52 while venting oil from advance chambers 50. Pressurized oil from phasing oil control valve 64 is supplied to retard chambers 52 through annular camshaft retard oil passage 72 of camshaft 14, axial camshaft retard oil passages 74 of camshaft 14, and retard oil passages 62 of rotor 20. At the same time, oil is vented from advance chambers 50 through annular camshaft advance oil passage 68 of camshaft 14, axial camshaft advance oil passages 70 of camshaft 14, and advance oil passages 60 of rotor 20. When no change in timing is desired between camshaft 14 the crankshaft, phasing oil control valve 64 is operated to substantially equalize the pressure between advance chambers 50 and retard chambers 52. This may be accomplished by providing minimal fluid communication from phasing oil control valve 64 to advance chambers 50 and retard chambers 52 simultaneously. In this way, rotor 20 rotates within stator 18 between a maximum advance position and a maximum retard position as determined by the space available for vanes 46 to move within radial chambers 38. Alternatively, an oil control valve may be provided within camshaft phaser to control the supply and venting of oil to and from advance chambers 50 and vented from retard chambers 52 as is known in the art, for example as shown in United States Patent Application Publication No. US 2012/0255509 A1 to Lichti et al. which is incorporated herein by reference in its entirety.

Bias spring 26 is disposed within an annular pocket 76 formed in rotor 20 and within a central bore 78 of front cover 24. Bias spring 26 is grounded at one end thereof to front cover 24 and is attached at the other end thereof to rotor 20. In this way, bias spring 26 either partially or completely offsets the natural retarding torque induced by the overall valve train friction, balances performance times, or helps return the phaser to a default position of rotor 20 within stator 18.

Figure 5:
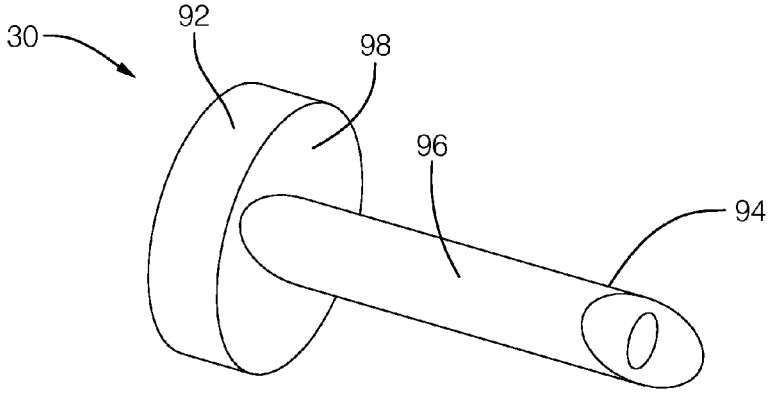
FIG. 5 is an isometric view of a lock pin of the camshaft phaser in accordance with the present invention.
Figure 6:
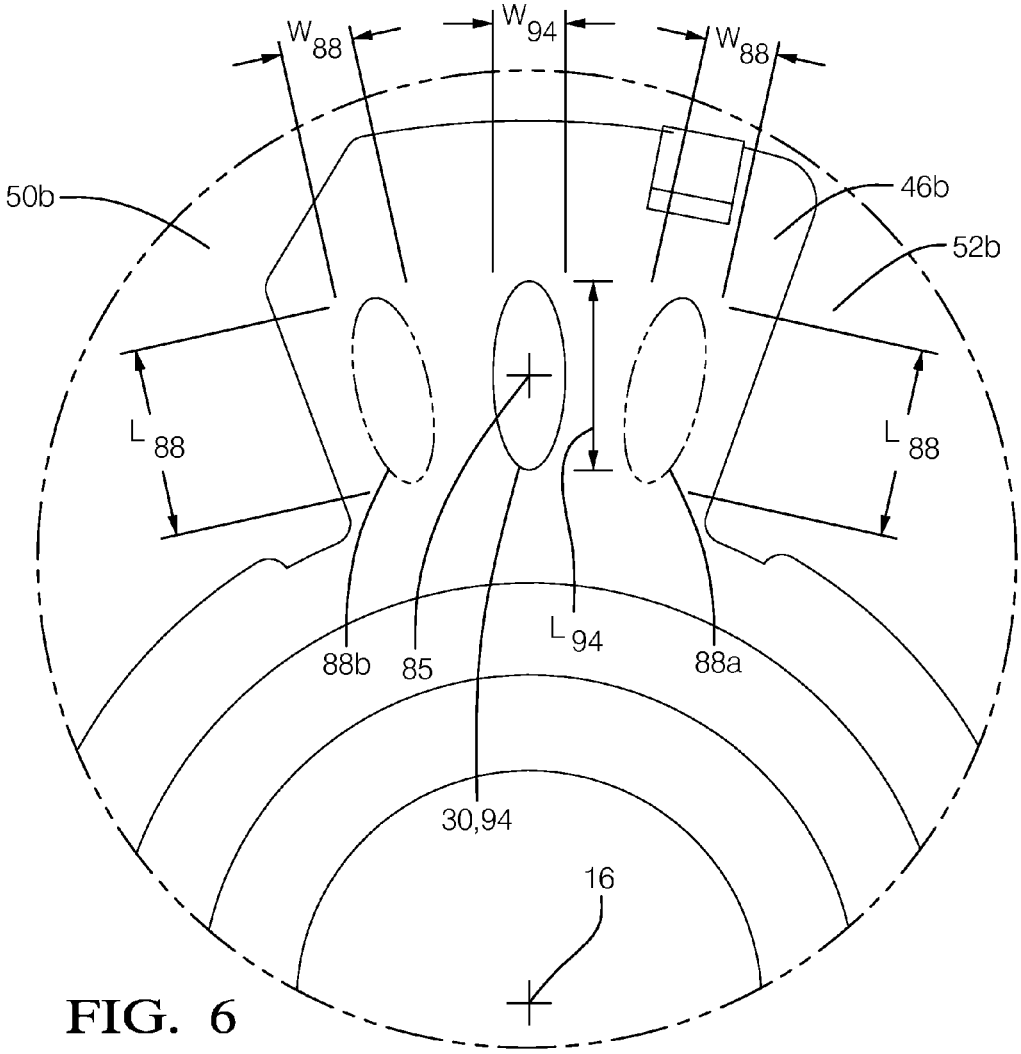
FIG. 6 is an enlarged elevation view of a vane of a rotor of the camshaft phaser in accordance with the present invention showing the lock pin of FIG. 5 centered between two lock pin seats.

With continued reference to FIGS. 1-4 and now with additional reference to FIGS. 5 and 6, primary lock pin 28 and secondary lock pin 30 define a staged dual lock pin system for selectively preventing relative rotation between stator 18 and rotor 20 at a first predetermined aligned position and for selectively preventing relative rotation between stator 18 and rotor 20 a second predetermined aligned position. The first predetermined aligned position may be between the full retard and the full advance positions while the second predetermined aligned position may be the full retard position, however, it should be understood that the first predetermined aligned position and the second predetermined aligned position may each be at other positions. As shown, the first predetermined aligned position may be separated from the second predetermined aligned position by, for example only, about 25°. Primary lock pin 28 is slidably disposed along a primary lock pin axis 79 within a primary lock pin bore 80 formed in vane 46*a* of rotor 20. Primary lock pin 28 and primary lock pin bore 80 may each be cylindrical as shown and primary lock pin axis 79 may be substantially parallel to camshaft axis 16. A primary lock pin seat 82 is formed in front cover 24 for selectively receiving primary lock pin 28 therewithin. Primary lock pin seat 82 is larger than primary lock pin 28 to allow rotor 20 to rotate relative to stator 18 about 5° on each side of the first predetermined aligned position when primary lock pin 28 is seated within primary lock pin seat 82. The enlarged nature of primary lock pin seat 82 allows primary lock pin 28 to be easily received therewithin. When primary lock pin 28 is not desired to be seated within primary lock pin seat 82, pressurized oil is supplied to primary lock pin 28, thereby urging primary lock pin 28 out of primary lock pin seat 82 along primary lock pin axis 79 and compressing a primary lock pin spring 84. Conversely, when primary lock pin 28 is desired to be seated within primary lock pin seat 82, the pressurized oil is vented from primary lock pin 28, thereby allowing primary lock pin spring 84 to urge primary lock pin 28 toward front cover 24 along primary lock pin axis 79. In this way, primary lock pin 28 is seated within primary lock pin seat 82 by primary lock pin spring 84 when rotor 20 is positioned within stator 18 to allow alignment of primary lock pin 28 with primary lock pin seat 82. Supplying and venting of pressurized oil to and from primary lock pin 28 will be described in greater detail later.

Secondary lock pin 30 is slidably disposed along a secondary lock pin axis 85 within a secondary lock pin bore 86 formed in vane 46*b* of rotor 20. Secondary lock pin axis 85 may be substantially parallel to camshaft axis 16. A first secondary lock pin seat 88*a* and a second secondary lock pin seat 88*b* are formed in front cover 24 for selectively receiving secondary lock pin 30 therewithin. Secondary lock pin 30 fits within first secondary lock pin seat 88*a* and second secondary lock pin seat 88*b* in a close sliding relationship, thereby substantially preventing relative rotation between rotor 20 and stator 18 when secondary lock pin 30 is received within first secondary lock pin seat 88*a* or second secondary lock pin seat 88*b*. When secondary lock pin 30 is not desired to be seated within either first secondary lock pin seat 88*a* or second secondary lock pin seat 88*b*, pressurized oil is supplied to secondary lock pin 30, thereby urging secondary lock pin 30 out of first secondary lock pin seat 88*a* or second secondary lock pin seat 88*b* along secondary lock pin axis 85 and compressing a secondary lock pin spring 90. As shown, secondary lock pin spring 90 is round, however, it should be understood that secondary lock pin spring 90 may alternatively be oval-shaped or any other shape that lends itself to the shape of secondary lock pin 30. Conversely, when secondary lock pin 30 is desired to be seated within either first secondary lock pin seat 88*a* or second secondary lock pin seat 88*b*, the pressurized oil is vented from secondary lock pin 30, thereby allowing secondary lock pin spring 90 to urge secondary lock pin 30 toward front cover 24 along second secondary lock pin axis 85. In this way, secondary lock pin 30 is seated within first secondary lock pin seat 88*a* or second secondary lock pin seat 88*b* by secondary lock pin spring 90 when rotor 20 is positioned within stator 18 to allow alignment of secondary lock pin 30 with first secondary lock pin seat 88*a* or second secondary lock pin seat 88*b* respectively. Furthermore, secondary lock pin 30 is aligned with first secondary lock pin seat 88*a* when primary lock pin 28 is centered with primary lock pin seat 82 and consequently, primary lock pin 28 being seated with primary lock pin seat 82 allows for secondary lock pin 30 to more easily seat with secondary lock pin seat 88*a* since primary lock pin 28 confines rotor 20 to about 10° of total travel. It should be noted that primary lock pin 28 is not used to aid in seating secondary lock pin 30 with second secondary lock pin seat 88*b* because secondary lock pin 30 is aligned with second secondary lock pin seat 88*b* when vane 46*b* contacts the adjacent vane 40, thereby making alignment of secondary lock pin 30 with second secondary lock pin seat 88*b* more easy to accomplish than aligning secondary lock pin 30 with first secondary lock pin seat 88*a*. Supplying and venting of pressurized oil to and from secondary lock pin 30 will be described in greater detail later.

Secondary lock pin 30 is defined by a shoulder end 92, a pin locking end 94 which is selectively received within first secondary lock pin seat 88*a* and second secondary lock pin seat 88*b*, and an intermediate section 96 connecting shoulder end 92 to pin locking end 94. Shoulder end 92 is defined by a shoulder 98 which is substantially perpendicular to secondary lock pin axis 85 and provides a surface for pressurized oil to react against when pressurized oil is used to unseat secondary lock pin 30 from first secondary lock pin seat 88*a* or second secondary lock pin seat 88*b*. Shoulder end 92 may be substantially cylindrical as shown and rides closely within a complementary lower portion 100 of secondary lock pin bore 86 such that pressurized oil used to unseat secondary lock pin 30 from first secondary lock pin seat 88*a* or second secondary lock pin seat 88*b* is substantially prevented from passing between shoulder end 92 of secondary lock pin 30 and lower portion 100 of secondary lock pin bore 86.

Pin locking end 94 is the portion of secondary lock pin 30 which is received within first secondary lock pin seat 88*a* or second secondary lock pin seat 88*b* when oil is drained from secondary lock pin 30. Pin locking end 94 is non-circular, and as shown, may be oval or elliptical in shape. Pin locking end 94 has a lock pin width $W_{94}$ measured in the circumferential direction relative to camshaft axis 16, i.e. the direction which rotor 20 rotates within stator 18. Pin locking end 94 also has a lock pin length $L_{94}$ measured in the direction that is perpendicular to lock pin width $W_{94}$ and also perpendicular to secondary lock pin axis 85. As shown, lock pin length $L_{94}$ is in the direction radially outward relative to camshaft axis 16. In this way, pin locking end 94 is elongated in the direction radially outward relative to camshaft axis 16. Pin locking end 94 rides closely within a complementary upper portion 102 of secondary lock pin bore 86 when secondary lock pin 30 is unseated from first secondary lock pin seat 88*a* and second secondary lock pin seat 88*b*.

Intermediate section 96 may be shaped substantially the same as pin locking end 94 and extends from pin locking end 94 to shoulder end 92. Intermediate section 96 rides closely within upper portion 102 of secondary lock pin bore 86 which prevents secondary lock pin 30 from rotating about secondary lock pin axis 85.

First secondary lock pin seat 88*a* and second secondary lock pin seat 88*b* are each non-circular, and as shown, may be oval or elliptical in shape to be complementary to pin locking end 94 of secondary lock pin 30. First secondary lock pin seat 88*a* and second secondary lock pin seat 88*b* each have a seat width $W_{88}$ measure in the circumferential direction relative to camshaft axis 16, i.e. the direction which rotor 20 rotates within stator 18. First secondary lock pin seat 88*a* and second secondary lock pin seat 88*b* each also have a seat length $L_{88}$ measured in the direction that is perpendicular to seat width $W_{88}$ and also perpendicular to secondary lock pin axis 85. As shown, seat length $L_{88}$ is in the direction radially outward relative to camshaft axis 16. In this way, first secondary lock pin seat 88*a* and second secondary lock pin seat 88*b* are each elongated in the direction radially outward relative to camshaft axis 16.

By making lock pin width $W_{94}$ less than lock pin length $L_{94}$ and seat width $W_{88}$ less than seat length $L_{88}$, the strength of secondary lock pin 30 may be maintained to prevent rotation of rotor 20 relative to stator 18 while preventing secondary lock pin 30, first secondary lock pin seat 88*a*, and second secondary lock pin seat 88*b* from providing fluid communication between advance chamber 50*b* and retard chamber 52*b* when secondary lock pin 30 is centered between first secondary lock pin seat 88*a* and second secondary lock pin seat 88*b*. Fluid communication between advance chamber 50*b* and retard chamber 52*b* is prevented under this condition, as best illustrated in FIG. 6, because lock pin width $W_{94}$ and seat width $W_{88}$ are sufficiently narrow so as to prevent a simultaneous overlap of secondary lock pin 30 with first secondary lock pin seat 88*a* (shown in phantom lines) and second secondary lock pin seat 88*b* (shown in phantom lines), first secondary lock pin seat 88*a* with retard chamber 52*b*, and second secondary lock pin seat 88*b* with advance chamber 50*b*. Since fluid communication between advance chamber 50*b* and retard chamber 52*b* is prevented when secondary lock pin 30 is centered between first secondary lock pin seat 88*a* and second secondary lock pin seat 88*b*, fluid communication between advance chamber 50*b* and retard chamber 52*b* will also be prevented at all other rotational positions of rotor 20 relative to stator 18.

Lock pin control valve spool 34 may be slidably disposed within a valve bore 104 of camshaft phaser attachment bolt 32 such that valve bore 104 is centered about camshaft axis 16. Lock pin control valve spool 34 includes lands 106 and is axially displaced within valve bore 104 by an actuator 108 and a valve spring 110. Actuator 108 may be a solenoid actuator and may urge lock pin control valve spool 34 to a lock pin disengaged position by applying an electric current to actuator 108. Application of an electric current to actuator 108 causes lock pin control valve spool 34 to move toward the bottom of valve bore 104, thereby compressing valve spring 110 and positioning lands 106 to prevent oil from being vented from to primary lock pin 28 and secondary lock pin 30 while allowing pressurized oil to be supplied to primary lock pin 28 and secondary lock pin 30 via primary lock pin oil passage 112 and secondary lock pin oil passage 114 in rotor 20 from valve bore 104 which is supplied by oil source 66, for example, by a camshaft lock pin valve oil passage 116 in camshaft 14 and camshaft phaser attachment bolt 32. Conversely, valve spring 110 may urge lock pin control valve spool 34 to a lock pin engaged position when no electric current is applied to actuator 108. When no electric current is applied to actuator 108, lock pin control valve spool 34 is moved away from the bottom of valve bore 104 by valve spring 110, thereby positioning lands 106 to prevent pressurized oil from being supplied to primary lock pin 28 and secondary lock pin 30 and to vent oil from primary lock pin 28 and secondary lock pin 30. Further details of the operation of operation of lock pin control valve spool 34 and oil passages associate therewith are describe in copending U.S. patent application Ser. No. 13/667,127 to Lichti et al., the disclosure of which is incorporated herein by reference in its entirety. While lock pin control valve spool 34 has been described as being located within camshaft phaser 12, it should be understood that a valve external to camshaft phaser 12 may alternatively be used as is known in the art, for example as shown in United States Patent Application Publication No. US 2012/0255509 A1 to Lichti et al. which is incorporated herein by reference in its entirety.

While primary lock pin 28 and secondary lock pin 30 have been shown and described as riding directly within primary lock pin bore 80 and secondary lock pin bore 86 of rotor 20 respectively, it should now be understood that primary lock pin 28 and/or secondary lock pin 30 may be implemented using a lock pin bushing as taught in U.S. Pat. No. 8,056,519 to Cuatt et al., the disclosure of which is incorporated herein by reference in its entirety. Using a lock pin bushing may allow upper portion 102 of secondary lock pin bore 86 to be cylindrical while using a feature of the lock pin bushing to orient secondary lock pin 30 relative to first secondary lock pin seat 88*a* and second secondary lock pin seat 88*b*.

While primary lock pin 28 and secondary lock pin 30 have been shown and described as operating substantially parallel to camshaft axis 16, commonly referred to as axially acting, it should now be understood that primary lock pin 28 and secondary lock pin 30 may act in a direction radially outward from camshaft axis 16, commonly referred to as radially acting. It should also be understood that primary lock pin 28 and secondary lock pin 30 may alternatively be housed within rotor 20 or an element secured thereto.

While this invention has been described in terms of preferred embodiments thereof, it is not intended to be so limited, but rather only to the extent set forth in the claims that follow.

I claim:

1. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft;

a rotor disposed within said stator, said rotor having a plurality of vanes interspersed with said lobes such that said rotor is rotatable within said stator about a camshaft axis and defining alternating advance chambers and retard chambers, wherein said advance chambers receive pressurized oil in order to change the phase relationship between said crankshaft and said camshaft in an advance direction and said retard chambers receive said pressurized oil in order to change the phase relationship between said camshaft and said crankshaft in a retard direction; and a lock pin slidably disposed along a lock pin axis within one of said rotor and said stator for selective engagement with a first lock pin seat for preventing a change in phase relationship between said rotor and said stator at a first predetermined aligned position of said rotor relative to said stator and for selective engagement with a second lock pin seat for preventing a change in phase relationship between said rotor and said stator at a second predetermined aligned position of said rotor relative to said stator;

wherein said lock pin has a lock pin width measured in a circumferential direction relative to said camshaft axis that is less than a lock pin length measured perpendicular to said lock pin width and to said lock pin axis.

2. A camshaft phaser as in claim 1 wherein said first lock pin seat and said second lock pin seat each have a seat width measured in said circumferential direction relative to said camshaft axis and a seat length measured perpendicular to said seat width and to said lock pin axis such that said seat width is less than said seat length.

3. A camshaft phaser as in claim 2 wherein said lock pin is slidably disposed within one of said plurality of vanes of said rotor.

4. A camshaft phaser as in claim 3 wherein said lock pin, said first lock pin seat, and said second lock pin seat do not together provide fluid communication between said advance chamber and said retard chamber defined by said one of said plurality of vanes when said rotor is rotated relative to said stator such that said lock pin is centered between said first lock pin seat and said second lock pin seat.

5. A camshaft phaser as in claim 2 wherein said lock pin length is in a direction radially outward from said camshaft axis.

6. A camshaft phaser as in claim 5 wherein said seat length is in a direction radially outward from said camshaft axis.

7. A camshaft phaser as in claim 1 wherein said lock pin, said first lock pin seat, and said second lock pin seat do not together provide fluid communication between any of said advance chambers and said retard chambers when said rotor is rotated relative to said stator such that said lock pin is centered between said first lock pin seat and said second lock pin seat.

8. A camshaft phaser as in claim 1 wherein:

said first predetermined aligned position is between a full advance position of said rotor relative to said stator and a full retard position of said rotor relative to said stator; and said second predetermined aligned position is said full retard position of said rotor relative to said stator.

9. A camshaft phaser as in claim 1 wherein said lock pin comprises:

a shoulder end defined by a shoulder that is substantially perpendicular to said lock pin axis and slidably disposed within a lower portion of a lock pin bore of said rotor;

a pin locking end for selective engagement with said first lock pin seat and said second lock pin seat, said pin locking end being slidably disposed within an upper portion of said lock pin bore of said rotor when said pin locking end is not engaged with either said first lock pin seat and said second lock pin seat, wherein said pin locking end has said lock pin width and said lock pin length.

10. A camshaft phaser as in claim 9 where said lock pin further comprises an intermediate section connecting said shoulder end to said pin locking end, said intermediate section being slidably disposed within said upper portion of said lock pin bore.

11. A camshaft phaser as in claim 10 wherein said upper portion of said lock pin bore prevents rotation of said lock pin about said lock pin axis.

12. A camshaft phaser as in claim 10 wherein said intermediate section is not cylindrical.

13. A camshaft phaser as in claim 12 wherein said intermediate section is elongated in the same direction as said pin locking end.

14. A camshaft phaser as in claim 9 wherein said shoulder end is cylindrical.

15. A camshaft phaser as in claim 14 wherein said lower portion of said lock pin bore is cylindrical.

* * * * *